United States Patent [19]

Torabi

[11] Patent Number: 4,694,609

[45] Date of Patent: Sep. 22, 1987

[54] DOUBLE-HUNG CLOSURE FOR ACCESS OPENINGS

[76] Inventor: Mohammad T. Torabi, 6657 S. Penrose Ct., Littleton, Colo. 80121

[21] Appl. No.: 941,760

[22] Filed: Dec. 15, 1986

[51] Int. Cl.[4] ..... E05D 15/50

[52] U.S. Cl. ..... 49/193

[58] Field of Search ..... 49/193, 382; 16/231

[56] References Cited

U.S. PATENT DOCUMENTS

| | | | |
|---|---|---|---|
| 242,148 | 5/1881 | Paschke | 49/193 |
| 1,934,546 | 11/1933 | Lewerentz | 49/193 X |
| 4,222,149 | 9/1980 | Holbek | 49/193 X |

*Primary Examiner*—Philip C. Kannan

*Attorney, Agent, or Firm*—Edwin L. Spangler, Jr.

[57] ABSTRACT

This invention relates to an improved auxiliary frame assembly for use between the fixed frame bordering an access opening and the cover therefor which hinges the latter to be opened from either side, such assembly being characterized by an inner movable frame hingedly attached on one side to the fixed frame and on the other side to the access opening cover, an outer movable frame bordering the inner one movable independently of the latter, this outer movable frame being hingedly attached to the fixed frame on the same side of the access opening at which the inner frame is attached to the cover, and the outer movable frame being hingedly attached to the cover on the same side of the access opening at which the inner movable frame is hinged to the fixed one, the outer movable frame and access opening cover cooperating to define a unitary subassembly hinged on the side where the inner frame is hinged to the fixed frame, and the inner movable frame and access opening cover cooperating to define a second subassembly hinged on the side where the outer movable frame is hinged to the fixed frame.

8 Claims, 9 Drawing Figures

DOUBLE-HUNG CLOSURE FOR ACCESS OPENINGS

BACKGROUND OF THE INVENTION

There are a number of applications wherein closures for access openings could conveniently be hinged on both sides, i.e. "double-hung" so that the closure would swing open and closed from either the right or the left. In the case of entryways and windows, cabinet doors and the like, the hinge axes would be vertical; however, there are applications like automobile hoods, lids for large open-topped receptacles and other such commonplace items where the selfsame principles could advantageously be applied to closures hinged along horizontal lines. A need, therefore, exists for a sturdy, reliable and essentially sagproof way of mounting a closure within an access opening such that it can be actuated from either side.

FIELD OF THE INVENTION

The present invention relates to a novel and improved double-hung closure for access openings wherein the closure is securely hinged to one side of the frame or the other bordering the opening at all times such that it cannot pull free of the unhinged side "accordian style" and thus sag. Other types of double-hung closures break due to the presence of the long unsupported arms running along the ends of the closure between the widely-spaced parallel hinge axes.

DESCRIPTION OF THE RELATED ART

The broad concept of hanging a door or the like within an access opening to open from either side is an old one. Most of the early designs were predicated upon the principle of the tumbling block puzzle which had a plurality of blocks interconnected by strips of webbing or the like, one such strip running down the middle of the blocks while two others ran along their edges. By stacking the block "accordion-style", the ones on either end could be opened from either side with one edge being held by the pair of straps and the other by the single strap. Placing a penny between the two straps on one of the intermediate blocks and then shifting the blocks thereabove over so as to hinge from the other side would place the penny underneath the intermediate strap much to everyone's amazement.

Arrangements not unlike the above were made the subject of prior art patents and intended, among other things, for use as refrigerator doors and the like as seen in U.S. Pat. No. 4,132,034 to Van Siclen. Other similar arrangements can be found in the U.S. Pat. No. 3,441,976 to Bellomo, U.S. Pat. No. 2,604,674 issued to Johnson, and Maleck's U.S. Pat. No. 3,889,419. Somewhat different approaches, but intended for the same purpose, can be found in the U.S. Pat. No. 2,624,909 to Kujawa; Nilsson U.S. Pat. No. 4,466,676; Holbeck U.S. Pat. No. 4,222,149; Parera U.S. Pat. No. 3,733,749 and Sanders U.S. Pat. No. 3,685,093. The McClure U.S. Pat. No. 2,596,706 takes a unique approach to the problem by merely rotating the whole door mounting assembly a half revolution. In Schacht U.S. Pat. No. 3,676,955, on the other hand, one frame is hinged on an edge while another is hinged in the middle. The Grose U.S. Pat. No. 3,138,829 hinges the access cover on both sides of the access opening, however, it opens inwardly from one such hinge connection and outwardly from the other.

The closest prior art known to applicant is found in the very early U.S. Pat. No. 115,774 to Sweetlands which is not too different from the apparatus shown in the previously-mentioned Bellomo patent; however, the latter and most of the other double-hung door constructions have the common shortcoming of sagging due to the presence of long support arms that extend all the way across from the hinged side of the door to the latch side. Sweetlands, on the other hand, while it has two hingedly interconnected frames, they open accordion-fashion and thus also are subject to severe sagging problems. In simple terms, an intermediate frame is hinged along one edge within the access opening while the cover or door for the access opening is hinged along the opposite edge. Thus, when opening from one side, the frame and door swing open as a unit; whereas, in the opposite mode, the frame stays with the access opening and the door swings from the opposite side of the frame.

Units constructed in the manner mentioned above with respect to Sweetlands can open accordion-fashion or so as to form a more or less "Z-shaped" configuration which is responsible for the sagging problem. Disabling one side in the manner of Bellomo is a solution, however, the double-hung functionality is lost which is the whole purpose of the construction in the first place. Others speak of the sagging problem but, so far as applicant can see, no one has solved it, at least in the manner he has done.

SUMMARY OF THE INVENTION

Applicant has discovered that these and other shortcomings of the prior art double-hung doors and the like can be solved by the simple, yet unobvious expedient of providing the assembly with a pair of movable frame elements interposed between the access opening cover and the opening itself, each of which is independently hingedly attached directly to the fixed frame bordering the access opening. As thus modified, the assembly has an inner movable frame hingedly attached to the fixed frame at one side of the access opening much in the manner of the prior art units. An outer movable frame surrounds the inner one and is also hingedly connected directly to the fixed frame bordering the access opening but on the opposite side thereof. The inner movable frame is then hingedly connected to the access opening cover on the same side thereof as where the outer movable frame is hingedly attached to the fixed frame, while the latter is hingedly connected to the access opening cover on the same side where the inner one is connected to the fixed frame. The resulting assembly, in addition to permitting the access opening cover to be opened from either side, becomes essentially "sagproof" in that regardless of how the cover is opened, it together with one of the movable frames cooperate with one another to define a unitary openable subassembly hinged directly to the fixed frame, the components of which are fastened together so as to prevent movement relative to one another. Moreover, the arrangement is such that when one of the aforementioned subassemblies is in its open position, the other of the movable frames cooperates with the fixed frame to define a second unitary subassembly in which the components remain in assembled relation and cannot be separated.

It is, therefore, the principal object of the present invention to provide a novel and improved double-hung cover for an access opening.

A second objective is the provision of an assembly of the type aforementioned wherein the assembly, even when open, is substantially as sturdy and free of sagging problems as a single-hung door.

Another object of the invention herein disclosed and claimed is that of providing a double-hung access opening cover which is equally applicable to access covers like, for example, automobile hoods, tailgates and other such items which are not rectangular or square.

Still another objective is that of providing a double-hung access opening cover wherein the several hinged connections are virtually invisible when the assembly is closed.

An additional object is the provision of a right and left-opening assembly which is conveniently operated by both right and left handers.

Further objects are to provide a double-hung door or the like which is simple yet versatile, decorative, rugged, adaptable to various shapes and sizes of access openings, and one that is easy to install.

Other objects will be in part apparent and in part pointed out specifically hereinafter in connection with the description of the drawings that follows.

DESCRIPTION OF THE PREFERRED EMBODIMENTS

Figure 1:
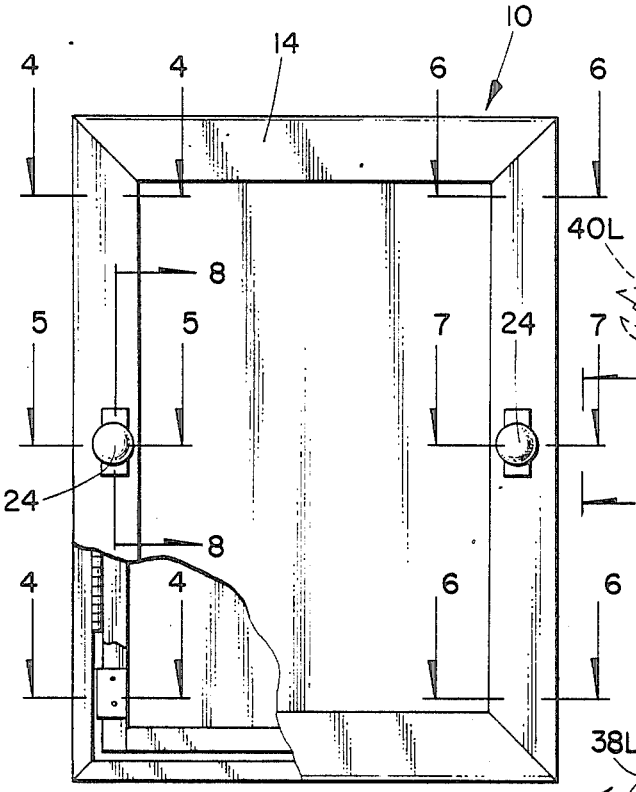
FIG. 1 is a front elevation of the double-hung door assembly showing the latter in closed position, portions of which have been broken away to reveal the interior construction.
Figure 2:
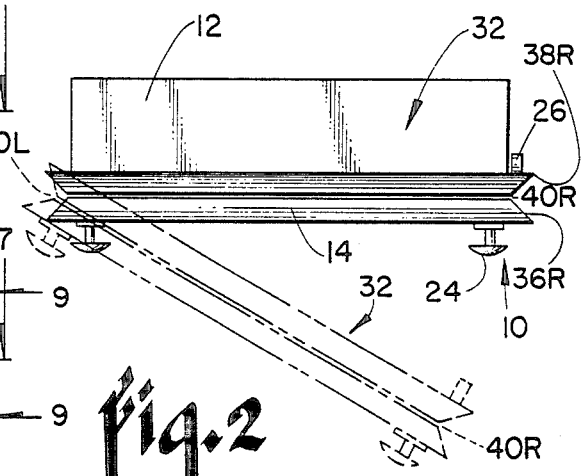
FIG. 2 is a top plan view thereof showing it closed in full lines and open to the left in phantom lines.
Figure 3:
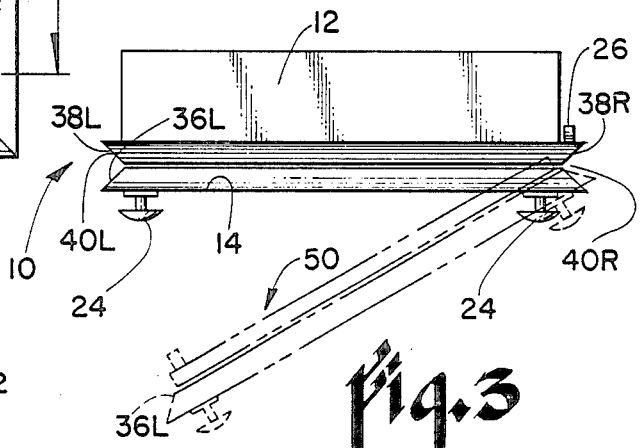
FIG. 3 is top plan view like FIG. 2 except that the unit is shown opening to right in phantom lines.

Referring next to the drawings for a detailed description of the present invention and, initially, to FIGS. 1, 2 and 3 for this purpose, reference numeral 10 has been chosen to broadly designate the double-hung access opening cover in its entirety while reference numerals 12 and 14 similarly designate the fixed frame bordering the access opening 16 and the cover therefor. In like manner, reference numeral 18 has been selected to identify in a general way the subassembly which comprises the pair of movable frames that define the operative connection between the fixed frame 12 that borders the access opening and the cover 14 therefor. The aforementioned subassembly 18 consists of inner movable frame and outer movable frame 22, the former fitting inside the latter. Inner movable frame 20 when in the closed position best seen in FIGS. 4 through 7, inclusive, constitutes in the particular form illustrated, a forward projection of the fixed frame 12. The outer movable frame 22, on the other hand, can be seen in these same figures to be somewhat of a mirror-image of the access opening cover 14 except that it is open in the middle to receive the inner one 20 as shown. Reference numeral 24 designates conventional door pulls while 26 are cabinet latches.

For simplicity of illustration, the fixed frame 12 has been shown as a rectangular box of some sort such as a medicine cabinet while the cover for the access opening in the latter is a simple door 14. It should be understood, however, that neither of these elements need be rectangular provided only that the common hinge axes defined by the hinges 28L and 30L parallel those on the other side of the access opening 16, 28R and 30R, all of which are clearly revealed in FIGS. 4 through 7 to which detailed reference will be made presently. By way of example, the fixed frame could just as easily be the portion of the body of an automobile housing the engine compartment while the cover therefor is the hood. Even circular, oval, triangular and especially trapezoidal covers, whether planar or curved, and associated compartments can be treated in the same way provided as aforementioned that spaced parallel hinge axes can be accommodated.

Figure 4:
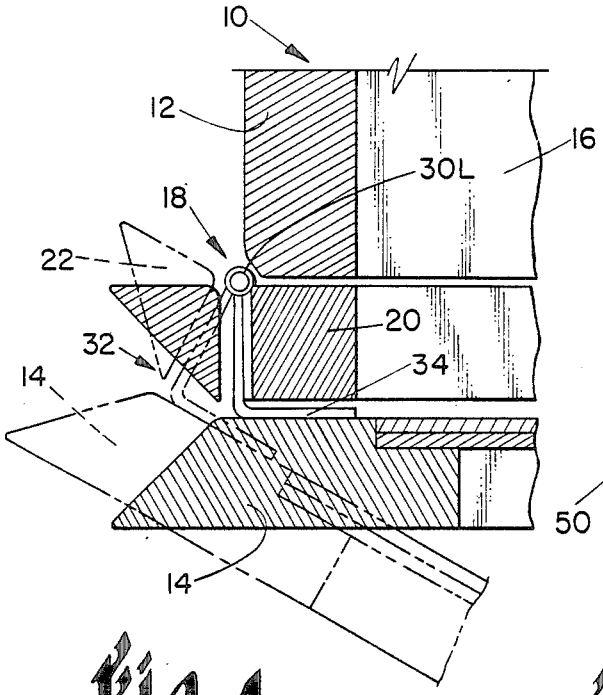
FIG. 4 is a fragmentary section to a greatly enlarged scale taken along line 4—4 of FIG. 1.
Figure 5:
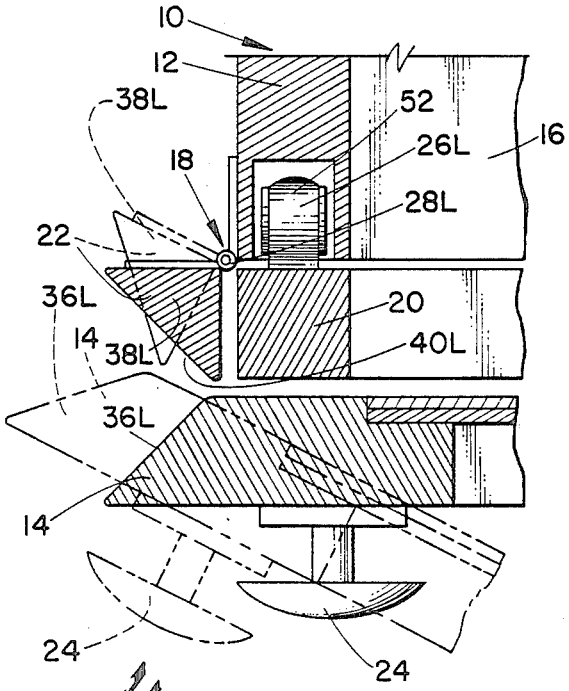
FIG. 5 is a fragmentary section to the same scale as FIG. 4 taken along line 5—5 of FIG. 1.
Figure 7:
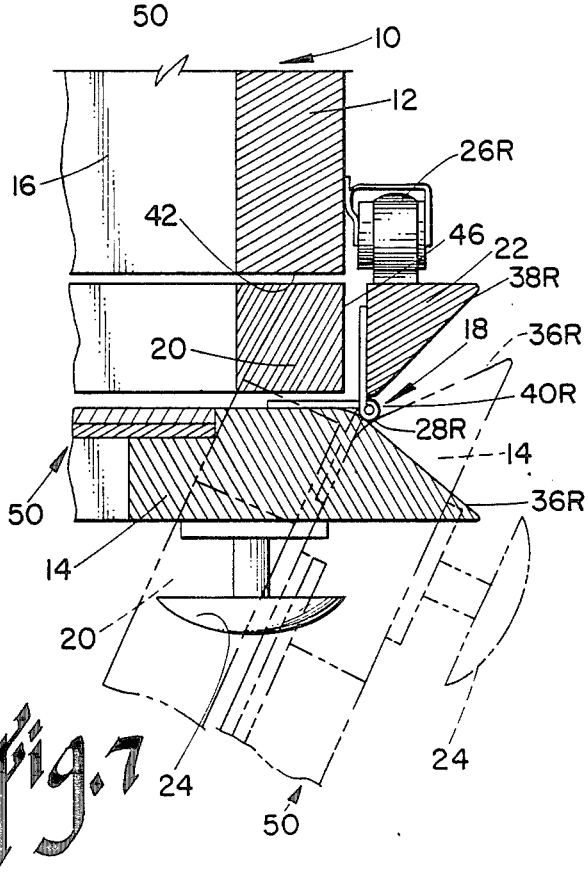
FIG. 7 is a fragmentary section to the same scale as FIGS. 4, 5 and 6 taken along line 7—7 of FIG. 1.

Turning attention to FIG. 4, it will be seen that hinges 30L hingedly attach the cover or door 14 to the inner movable frame element 20. A pair of hinges 30L are provided, one at the top of the assembly and the other at the bottom although only the top one has been shown. Functionally, these hinges 30L connect the access cover 14 and the outer movable frame element together along the lefthand side of the assembly 10 for movement together as a unitary subassembly 32 between the full line closed position and the phantom line open position shown. Door 14 cannot separate from the outer movable frame 22 on the right side because it is hinged thereto by hinge 28R as seen in FIG. 7. In like manner, the door 14 cannot separate from the outer movable frame 22 on the left side because the latter frame is hinged to the fixed frame 12 by hinge member 28L as seen in FIG. 5. In other words, the door 14 and outer frame 22, while independent of one another on the left side, nevertheless, move about a common hinge axis defined by hinges 28L and 30L and they cannot, for this reason, move relative to one another.

Turning now to FIG. 5, the hinge 28L in the particular form shown comprises a single long piano-type hinge interposed between the pair of hinges 30L. Alternatively, a pair of hinge butts 28L could be used in place of the single one shown. Hinges 30L and 30R, on the other hand, each have one right angle leaf 34 and, as such, are usually available in pairs and difficult, if not impossible, to find in the form of a piano-type hinge. Irrespective of the particular kind and arrangement of hinges used, any carpenter skilled in cabinet work would experience no difficulty whatsoever in properly hinging any of the elements of the assembly 10 to whatever other element functions as its support.

Comparing FIGS. 4 and 5, it will be seen that the elements of the subassembly that move together as a unit when the access opening cover is opened to the left consist of the outer movable frame 22 and the cover itself. As such, for aesthetic reasons, it is preferable that the left edge of the access cover 14 project beyond the corresponding edge of the fixed frame 12 and the inner movable frame 20 a distance sufficient to hide the outer movable frame 22 from frontal view. While opposed surfaces 36L and 38L of the cover 14 and the outer movable frame have been shown beveled at an angle of 45° so as to form a 90° channel 40L therebetween, this is not necessary for any functional reason since these opposed surfaces do not move relative to one another except when the cover is being opened from the left. They are shown in this form for purposes of symmetry, not functionality. On the other hand, opposed surfaces 36R on the righthand edge of the cover 14 and 38R on the righthand edge of the outer movable frame 22 cooperate to define a channel 40R that does have functional significance in that it permits the door to open and move into the phantom line position shown in FIGS. 6 and 7. Thus, on one side edge of the assembly, the beveled surfaces are purely for aesthetic purposes, whereas, these same beveled surfaces on the other side edge have an important functional purpose as previously noted as would certain alternative arrangements like, for example, grooving the righthand edge of access cover and recessing the hinge in the groove.

Directing the attention next to FIGS. 6 and 7, the relationship of the elements of the assembly 10 when the access cover 14 is opened to the right as shown in FIG. 3 will now be described. Looking first at FIG. 6, it will be seen that hinge pair 30R are revealed as having the same construction as pair 30L, however, their function is quite different. The right-angled leaf 34 is fastened to the forwardly-facing righthand edge 42 of the fixed frame 12 while the other leaf 44 attaches to the right-hand-facing right outside edge of the inner movable frame 20. Ignoring for the moment the access cover 14, this permits the inner frame 20 to swing out from its position inside the outer movable frame 22 into the phantom line position as is shown occupying in both FIGS. 6 and 7. A look back at FIG. 4 will reveal, however, that the inner frame and the access cover are interconnected for movement as a unitary subassembly by hinge pair 30L. Since hinge pair 30R only hingedly connects the inner movable frame 20 to the fixed frame and pair 30L similarly interconnects the inner frame to the access cover, this would leave the latter element free to swing out away from the inner frame were it not for the fact that the access cover is hingedly connected to the outer movable frame on the righthand side by hinge 28R as seen in FIG. 7. Hinge 28R is somewhat analogous to hinge 28L in that it represents a single piano-type hinge located between the pair 30R. Functionally, however, it is quite different in that it interconnects the access cover and outer movable frame in the manner already mentioned.

Figure 6:
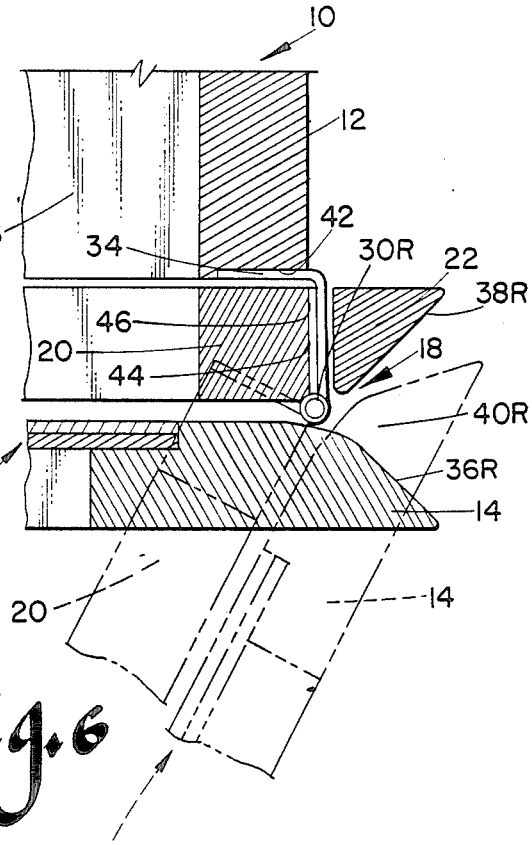
FIG. 6 is a fragmentary section to the same scale as FIGS. 4 and 5 taken along line 6—6 of FIG. 1.

Referring specifically to FIG. 7 and comparing it with FIG. 6, it can be seen that the axis of hinge 28R is coincident with that of hinge pair 30R. This being the case, the inner movable frame element 20 and the access cover 14 move as a unitary subassembly that has been indicated in a general way by reference numeral 50 as they swing out together from the full line into the phantom line position shown in FIGS. 6 and 7. The access door and the outer frame form mutual supports for one another on the righthand side while the access cover and the inner frame do so on the left. By the same token, the fixed frame supports the inner frame on the right, whereas, the fixed frame supports the outer frame on the left. It is significant to note that as soon as the subassembly 50 consisting of the inner frame and the access cover moves away from the fixed frame 12 and into the phantom line position shown in FIGS. 3, 6 and 7, it becomes physically impossible for the outer movable frame to move away from the fixed frame, this being an important aspect of the present invention. Likewise, once the movable frame and the access cover that cooperate to form subassembly 32 move away from the fixed frame and into the phantom line position of FIGS. 2, 4 and 5, it becomes physically impossible for the inner movable frame to separate from the fixed frame.

Again with reference to FIGS. 6 and 7, the rearwardly and outwardly divergent beveled surface 38R on the righthand edge of the outer frame 22 will be seen to cooperate with the forwardly and outwardly divergent beveled surface 36R on the righthand side of the access cover 14 to permit the latter to swing open as shown in phantom lines and eventually assume a right angular relation. It will also be apparent that the present construction leaves the access opening 16 completely unobstructed either by cross members or by either of the movable frames as a whole which is, of course, one of the objectionable features of many of the prior art double-hung structures like, for example, that of Van Siclen referred to previously. It is, of course, necessary to leave enough space between a supporting wall (not shown) and the front edge 42 of the fixed frame to accommodate the outer movable frame when it swings open to the left as shown in FIGS., 2, 4 and 5 or, alternatively, cut an oversize opening on the left for the fixed frame which will let the outer movable frame pass. Actually, such an oversize opening would be hidden behind the lefthand extension of the access cover and the outer frame itself, both with the subassembly 32 in closed position and especially when open thus permitting a flush mounting of the fixed frame.

Figure 8:
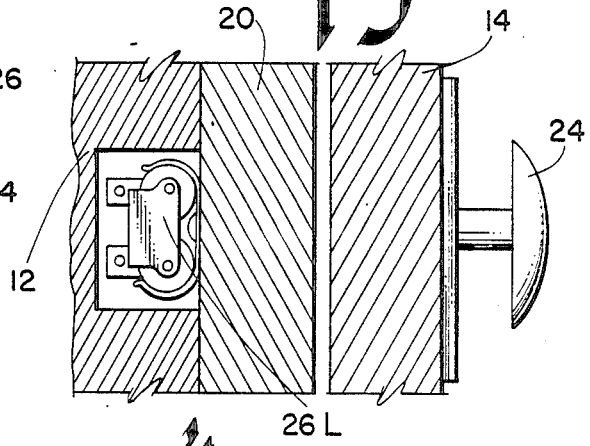
FIG. 8 is a fragmentary section to a still further enlarged scale taken along line 8—8 of FIG. 1; and, FIG. 9 is a fragmentary elevation to the same scale as FIG. 8 taken along line 9—9 of FIG. 1.

Looking next at FIGS. 5 and 8, it can be seen that in the particular form illustrated, a conventional cabinet latch 26L has been employed to releasably fasten subassembly 32 in closed position. Movable portion 52 of the latch is shown mounted on the rearwardly-facing left-hand edge of the inner movable frame 20 while the fixed portion 54 thereof is recessed into the forwardly-facing lefthand edge 42 of the fixed frame.

Figure 9:
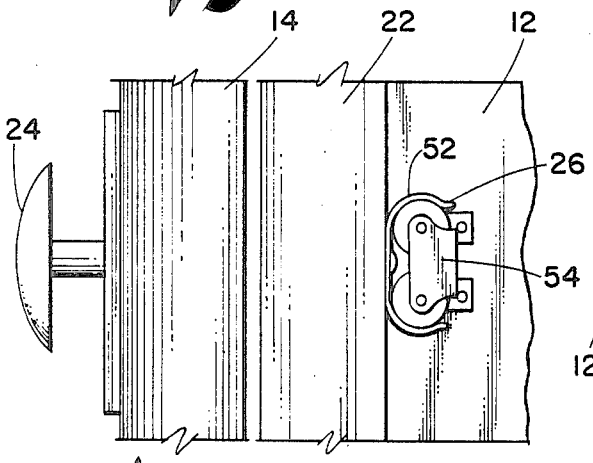

Cabinet latch 26R on the righthand side is mounted somewhat differently in order to accommodate the outer movable frame 22 which carries the movable part 52 of the latch on its rearwardly-facing righthand edge as can be seen in FIGS. 7 and 9. The fixed part 54, on the other hand, is fastened to the outside right-facing surface of the fixed frame 12 rather than being recessed. While positioned on the outside of the fixed frame it is, nevertheless, hidden behind the outer movable frame 22 whenever the access door is closed. It is only when the subassembly 32 consisting of the access door and the outer movable frame is open that it can be seen.

Accordingly, it can be seen that the double-hung access opening cover of the present invention completely eliminates the sagging problem so prevalent in the prior art units for this purpose while, at the same time, providing an effective and versatile assembly. Moreover, without having to disable the assembly in the sense of latching it in one operative mode or the other, it effectively prevents the elements from spreading out accordion-fashion which is another undesirable feature found in many of the prior art units that significantly contribute to their lack of rigidity and fragility.

What is claimed is:

1. For use in combination with an access opening bordered by a fixed frame and a cover therefor, the improved assembly for hinging the cover to open from either side of the frame which comprises: an outer movable frame and an inner movable frame, the inner movable frame being positioned inside the outer movable frame and each being movable independently relative to the other; a first hinged connection hingedly attaching the inner movable frame to the fixed frame on one side of the fixed frame; a second hinged connection having a hinge axis paralleling said first hinged connection hingedly attaching the inner movable frame to the access opening cover on the other side of said access opening; a third hinged connection with a hinge axis in common with said second hinged connection hingedly attaching the outer movable frame to the fixed frame on said other side of the access opening; and, a fourth hinged connection with a hinge axis in common with said first hinged connection hingedly attaching the outer movable frame to the access opening cover on said one side of the access opening, said inner movable frame and access opening cover cooperating with one another and with the first and fourth hinged connections to define a first unitary subassembly operative to cover and uncover the access opening by hinging the cover therefor on said one side of the latter, and said outer movable frame and access opening cover cooperating with one another and with the second and third hinged connections to define a second unitary subassembly operative to cover and uncover the access opening by hinging the cover therefor on said other side of the latter.

2. The improved assembly of claim 1 wherein: the inner movable frame is shaped to define an independently movable extension of the fixed frame projecting forwardly thereof and the outer movable frame borders the inner movable frame.

3. The improved subassembly of claim 1 wherein: the fourth hinged connection comprises a single hinge and the first hinged connection comprises a pair of hinges positioned to place the first hinged connection therebetween.

4. The improved subassembly of claim 1 wherein: the third hinged connection comprises a single hinge and the second hinged connection comprises a pair of hinges positioned to place the third hinged connection therebetween.

5. The improved subassembly of claim 1 wherein: the access opening cover is sized to cover the outer movable frame; and, wherein opposed surfaces of said outer movable frame and access opening cover on at least said one side of the access opening are oppositely beveled to produce a V-shaped channel therebetween which is effective to permit said first subassembly to open and uncover the access opening without interference.

6. The improved subassembly of claim 5 wherein: the opposed surfaces on access opening cover and movable outer frame are oppositely beveled on both said one side and said other side of the access opening.

7. The improved subassembly of claim 1 wherein: first latch means releasably latches the first unitary subassembly to the fixed frame on said other side of the access opening.

8. The improved subassembly of claim 7 wherein: second latch means releasably latches the second unitary subassembly to the fixed frame on said one side of the access opening.

* * * * *